US007934441B1

(12) United States Patent
Hyde

(10) Patent No.: US 7,934,441 B1
(45) Date of Patent: May 3, 2011

(54) COMBINATION TOOL

(76) Inventor: Lance N. Hyde, Westfield, IN (US)

( * ) Notice: Subject to any disclaimer, the term of this patent is extended or adjusted under 35 U.S.C. 154(b) by 110 days.

(21) Appl. No.: 12/421,854

(22) Filed: Apr. 10, 2009

(51) Int. Cl.
*B25B 13/46* (2006.01)

(52) U.S. Cl. ..... 81/63; 7/143

(58) Field of Classification Search ..... 81/62, 63.1, 81/58.4, 20, 177.2, 177.6–177.8, 21–27; 7/137, 143, 170
See application file for complete search history.

(56) References Cited

U.S. PATENT DOCUMENTS

| | | | | |
|---|---|---|---|---|
| 101,538 | A | 4/1870 | Stout | |
| 389,549 | A | 9/1888 | Crosby | |
| 456,189 | A | 7/1891 | Arnot | |
| 487,635 | A | 12/1892 | McGown | |
| 822,066 | A | 5/1906 | Morkert | |
| 1,565,102 | A | 12/1925 | Peterson | |
| 1,603,645 | A | 10/1926 | Snitzler | |
| 1,673,577 | A | 6/1928 | McGee | |
| 2,876,776 | A | 3/1959 | Williams | |
| 3,119,424 | A | 1/1964 | Henry | |
| 3,790,976 | A | 2/1974 | Stencil | |
| 4,531,716 | A * | 7/1985 | Rish | 254/21 |
| 5,033,140 | A | 7/1991 | Chen et al. | |
| D331,690 | S | 12/1992 | Villarreal | |
| 5,575,029 | A | 11/1996 | Simpson | |
| 5,970,552 | A | 10/1999 | Kwiecien et al. | |
| D419,050 | S | 1/2000 | Lin | |
| 6,279,876 | B1 * | 8/2001 | Massie | 254/26 E |
| 6,629,684 | B2 | 10/2003 | Youngren et al. | |
| 6,718,586 | B2 | 4/2004 | Corsini | |
| 6,739,010 | B1 | 5/2004 | Lin | |
| 6,796,205 | B2 * | 9/2004 | Wickes et al. | 81/427.5 |
| 6,971,292 | B2 * | 12/2005 | Hu | 81/177.8 |
| 7,010,822 | B1 * | 3/2006 | Lin | 7/143 |
| 7,065,819 | B1 | 6/2006 | Minniti | |
| 2009/0223061 | A1 * | 9/2009 | Seber et al. | 30/160 |

* cited by examiner

*Primary Examiner* — David B Thomas
(74) *Attorney, Agent, or Firm* — Luedeka, Neely & Graham, PC

(57) ABSTRACT

A combination tool includes a first tool component and a second tool component. A ratchet system enables the first tool component and the second tool component to be pivotally oriented relative to one another in a desired direction, and to be locked at desired relative orientation. A release mechanism enables the first tool component and the second tool component to be disengaged from one another for individual use.

9 Claims, 9 Drawing Sheets

COMBINATION TOOL

FIELD

This disclosure relates to the field of hand tools. More particularly, this disclosure relates to a tool having multiple uses and which incorporates a bi-directional ratchet mechanism that facilitates folding, unfolding, locking, and release of components of the tool.

BACKGROUND

Improvement is desired in the provision of combination tools, particularly those configured to having portions that pivot relative to one another and are separable for independent usage.

The present disclosure advantageously provides an improved combination tool. The tool incorporates an improved ratchet system that facilitates selective bi-directional positioning, locking, and separation of portions of the tool.

SUMMARY

The above and other needs are met in one aspect of the disclosure by a combination tool that includes a first tool component; a second tool component, a ratchet system incorporated into the first tool component, and a release mechanism incorporated into the ratchet system.

The ratchet system is configured to enable the first tool component and the second tool component to be pivotally oriented relative to one another in a desired direction, and to be locked at desired relative orientation; and The release mechanism is configured to enable the first tool component and the second tool component to be disengaged from one another for individual use.

In another aspect, the disclosure relates to a ratchet system. The ratchet system includes a tool end providing a first bore and a second bore aligned in a stacked configuration and extending into one another between meeting edges of the bores so that the bores are in communication with one another and have an overall figure-eight appearance, a ratchet gear having circumferential ratchet teeth located around the periphery thereof and seated within the second bore.

A pair of independently positionable double-lobed pawls are positioned within the first bore to overlie one another adjacent to the ratchet gear. Each double-lobed pawl has a rounded front portion, an opposite rounded rear portion, and a pair of lobes protruding from opposite circumferential sides thereof. The pawls are independently pivotable to selectively contact one of each of the lobes of each of the pawls in engagement or disengagement with the teeth of the ratchet gear to enable desired directional rotation of the ratchet gear or locking of the ratchet gear against rotation.

The ratchet system when utilized in the tool enables the first tool component and the second tool component to be pivotally oriented relative to one another in a desired direction and to be locked at desired relative orientation.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
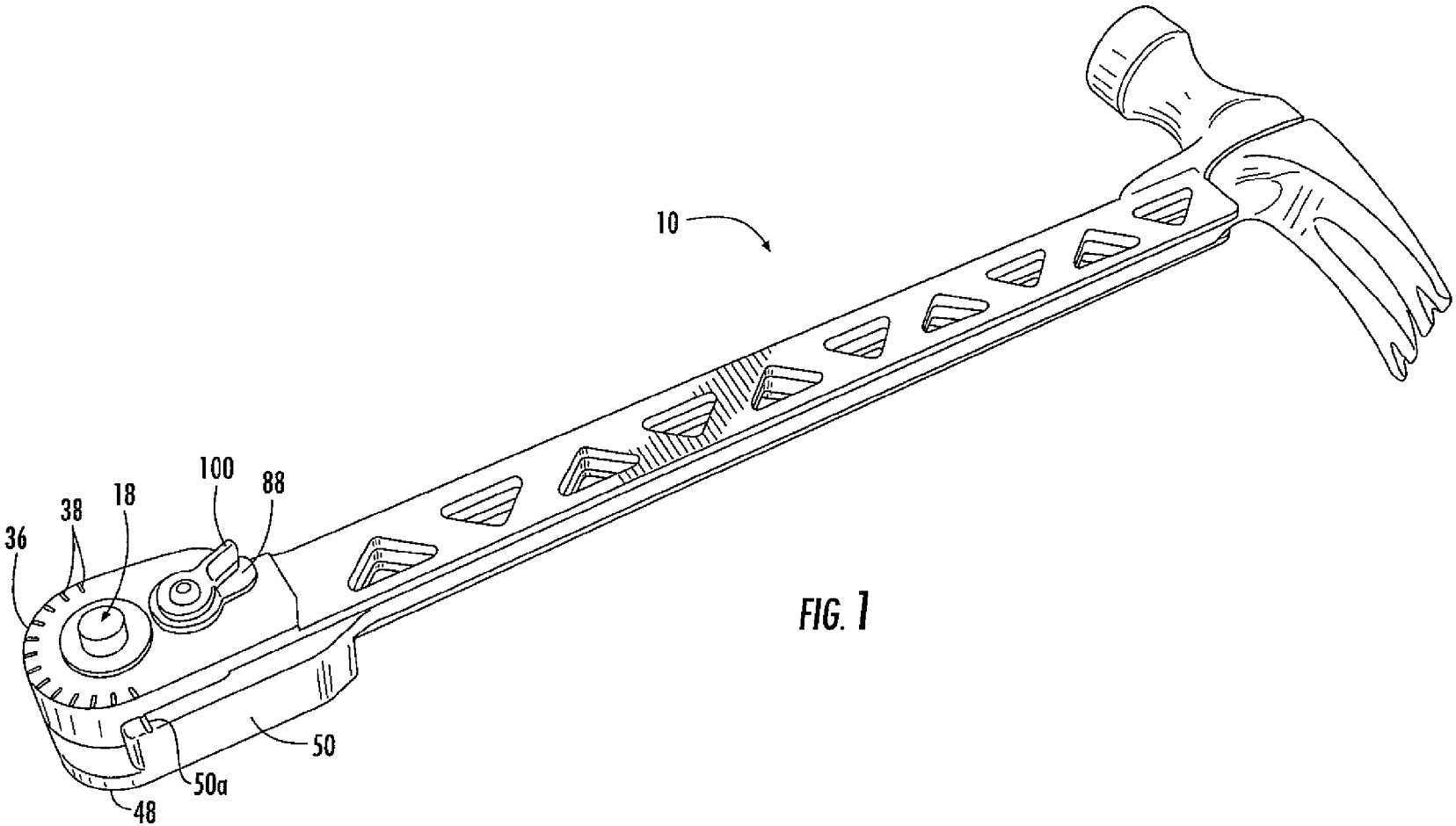
FIG. 1 is a perspective view of a combination tool according to a preferred embodiment of the disclosure, the tool shown having a first tool component and a second tool component assembled and in a folded orientation to provide a hammer.

With reference to the drawings, the disclosure relates to a combination tool 10 configured for multiple uses and having a first tool component 12 and a second tool component 14. An associated ratchet system 16 enables the first tool component 12 and the second tool component 14 to be pivotally oriented relative to one another in a desired direction, to be locked at desired relative orientation, and to cooperate with sockets to enable use of tool 10 as a ratchet wrench. A release mechanism 18 associated with the ratchet system 16 enables the first tool component 12 and the second tool component 14 to be disengaged from one another for individual use.

The tool 10 as depicted is configured to provide multiple functions. For example, representative tool functions provided by the tool 10 include a claw hammer, a finishing hammer, a multi-angle measuring tool, a wrecking bar, a pry bar, a ratchet wrench, and a ruler. These tool functions are provided by selective use of the components of the tool 10, as will be described in more detail below.

The first tool component 12 is preferably made of one-piece hardened steel construction suitable for use as a hammer. The component 12 includes an elongate shaft 20 configured for being grasped as a handle. The shaft 20 is provided by a pair of uniformly spaced apart shaft sections 20*a* and 20*b*. The shaft sections 20*a* and 20*b* may preferably include a plurality of aligned cutouts 21 along the length thereof. The cutouts 21 provide desired weight reduction to provide the component 12 with a desired weight. The cutouts 21 may also be provided in desired ornamental shapes, such as the shown triangles, so as to provide an ornamental and aesthetically pleasing appearance.

One end of the shaft 20 terminates at a first end 22 configured to provide a partial hammer head 24. The other end of the shaft 20 terminates at a second end 26 configured to receive the ratchet system 16. The first tool component 12 preferably has a length of from about 14 to 15 inches and a weight of from about 20 to about 24 ounces, although it will be understood that the component 12 may be of various lengths and weights.

The partial hammer head 24 of the first end 22 includes a front portion 24*a* shaped to include a neck 27, a poll 28, and a striking face 30. The head 24 may be configured to provide various desired hammer styles, such as plain faced, bell faced, and checkered face hammers. The head 24 shown is a bell faced style. A rear portion 24*b* of the head 24 is configured as a substantially planar surface parallel to the shaft 20 for mating with a portion of the second tool component 14, as described below.

Figure 6:
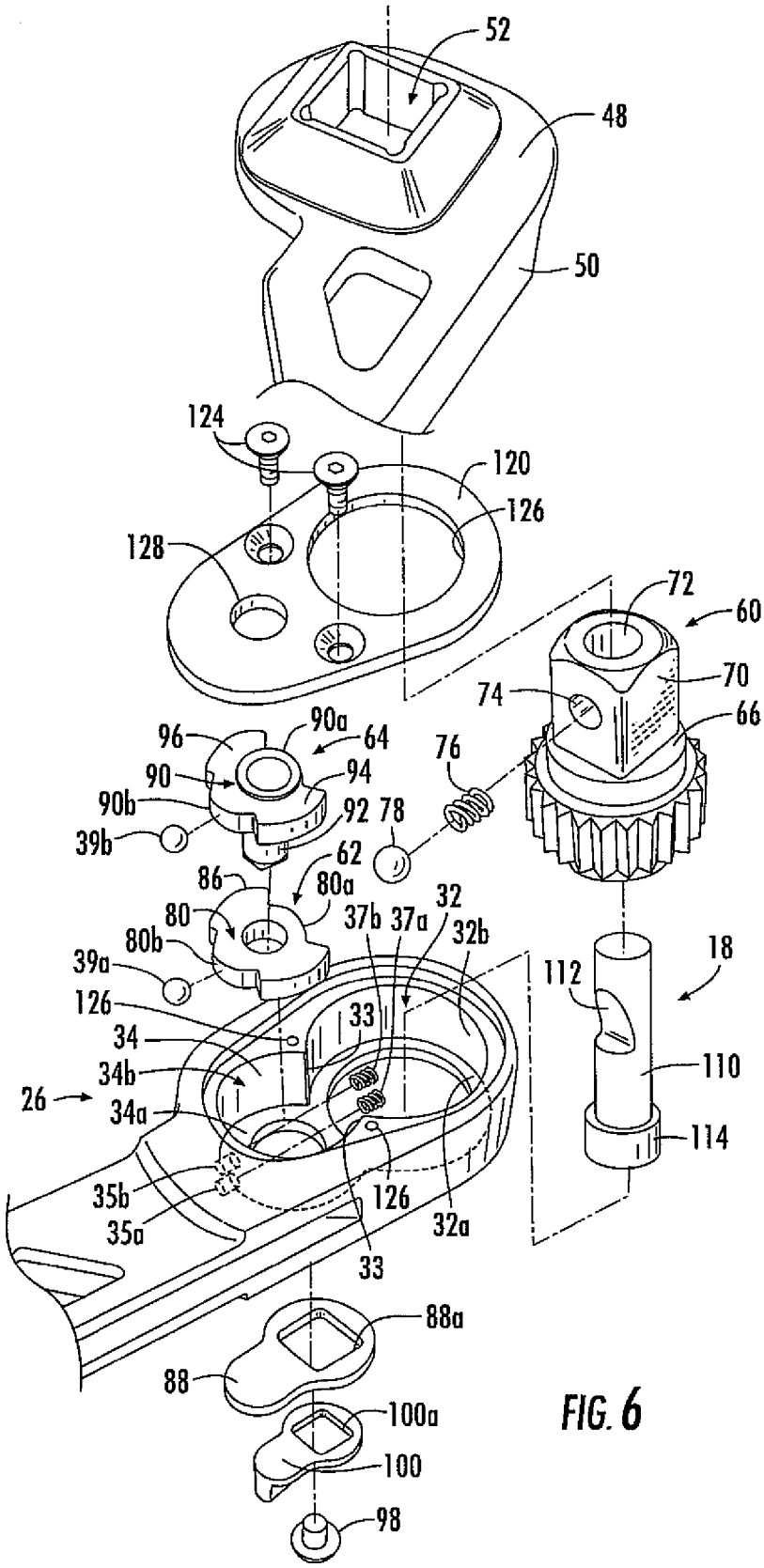
FIG. 6 is an enlarged exploded perspective view of components of a ratchet system and release mechanism incorporated in the tool of FIG. 1.

With reference to FIG. 6, the second end 26 of the first tool component 12 includes a pair of bores 32 and 34 configured for receiving components of the ratchet system 16, described below. The bores 32 and 34 are aligned in a stacked configuration and extend into one another between meeting edges 33 of the bores 32 and 34 so that the bores 32 and 34 are in communication with one another and have an overall figure-eight appearance. The bores 32 and 34 each extend through the thickness of the end 26, with one end of each being smaller than the opposite end so as to provide rims 32*a* and 34*a* surrounded by bore sidewalls 32*b* and 34*b*, respectively.

A pair of aligned and vertically stacked small bores 35*a* and 35*b* extend into the second end 26 at the rearmost portion of the sidewall 32*b*. The bores 35*a* and 35*b* are aligned with the central longitudinal axis of the bores 34 and 34 and the length of the shaft 20. Small compression coil springs 37*a* and 37*b* fit into the bores 35*a* and 35*b*, onto which are seated small ball bearings 39*a* and 39*b*, respectively, sized to fit within the bores 35*a* and 35*b*.

Returning to FIG. 1, an outermost edge 36 of the second end 26 of the first tool component 12 is curved, providing a semi-circle, so as to be able to rotate relative to the second tool 14. Angular demarcations 38 are preferably provided adjacent the edge 36 to enable angular reference points relative to the second tool component 14.

Returning to FIG. 2, the second tool component 14 includes an elongate shaft 40 configured for being grasped as a handle. The shaft 40 is configured to be received between the spaced apart shaft sections 20*a* and 20*b*. The shaft 40 may preferably include a plurality of cutouts 41 along the length thereof. The cutouts 41 preferably correspond to and are aligned with the cutouts 21 of the shaft 20 when the shaft 40 is received between the shaft sections 20*a* and 20*b*. Indicia 43 are also preferably located along the shaft 40. The indicia 43 preferably correspond to ruler demarcations so that the shaft 40 may serve as a ruler. If desired, the shaft 20 may also include such indicia.

One end of the shaft 40 terminates at a first end 42 configured to provide a hammer claw 44. The other end of the shaft 40 terminates at a second end 46 configured to cooperate with the second end 26 of the first tool component 12 and to mate with the ratchet system 16. The second tool component 14 preferably has a length of from about 14 to 15 inches and a weight of from about 10 to about 16 ounces, although it will be understood that the component 14 may be of various lengths and weights. Thus, together, the components 12 and 14 may provide a standard 40 ounce claw hammer, whereas apart, the component 12 may provide a 24 ounce finishing hammer.

The claw 44 includes a front portion 44*a* configured as a substantially planar surface parallel to the shaft 40 for mating with the portion 24*b* of the first tool component 12. A rear portion 44*b* of the claw 44 is configured to include a pair of spaced apart prongs 46*a* and 46*b* oriented to extend generally perpendicularly away from the shaft 40 in a v-shaped configuration. The prongs 46*a* and 46*b* are configured as pry surfaces and for pulling nails.

The second end 46 is configured to cooperate with the second end 26 of the first tool component 12 and to mate with the ratchet system 16. The second end 46 includes a substantially lateral surface 48 offset from the shaft 40 by a sidewall 50 that extends parallel and away from the shaft 40. The sidewall 50 includes a demarcation 50*a* to serve as reference point relative to the angular demarcations 38 of the first tool component 12. A square bore 52 extends through the lateral surface 48, with an outer portion 48*a* of the surface 48 surrounding the bore 52 being tapered upwardly so as to match the height of the received ratchet system 16.

Figure 5:
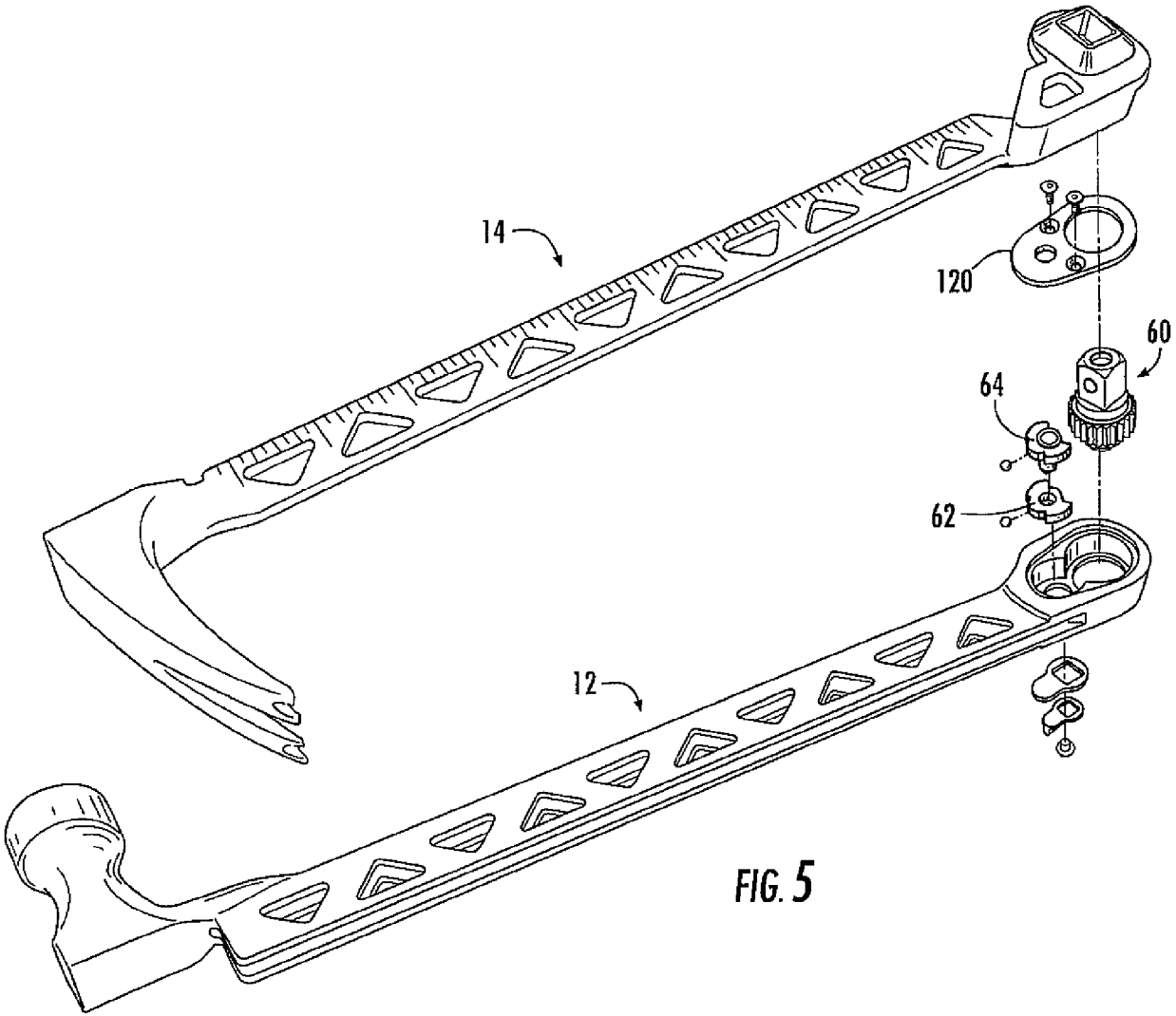
FIG. 5 is an exploded perspective view of the tool of FIG. 1.

With reference to FIGS. 5 and 6, the ratchet system 16 includes a ratchet gear 60 and a pair of independently positionable double-lobed pawls 62 and 64. The ratchet gear 60 is received by the bore 32 and the pawls 62 and 64 are received by the bore 34.

The ratchet gear 60 includes a ring-shaped body 66 having circumferential ratchet teeth 68 located around the periphery thereof. A socket extension 70 extends from one side of the body 66 and a longitudinal bore 72 is formed through the length of the body 66 and the socket extension 70 for receiving the release mechanism 18. A lateral bore 74 extends from a face of the socket extension 70 to the longitudinal bore 72 and receives a spring 76 and a ball bearing 78 associated with the release mechanism 18. The open end of the bore 74 is slightly narrowed so that the bearing 78 seated in the bore 74 cannot pass out from that end. The ratchet gear 60 is seated within the bore 32 and supported by the rim 32*a* with the socket extension 70 opposite the rim 32*a*.

The double-lobed pawl 62 includes a plate 80 having a rounded front portion 80*a* and an opposite rounded rear portion 80*b*, a central bore 82 and a pair of lobes 84 and 86 protruding from opposite circumferential sides of the plate 80 between the front portion 80*a* and rear portion 80*b*, such that the pawl 62 has a "butterfly shape."

The pawl 62 is seated in the bore 34 so that the front portion 80*a* is at the front of the bore 34 between the edges 33 adjacent the meeting of the bores 32 and 34, the rear portion 80*b* is at the rear of the bore 34 adjacent the shaft 20, and the lobes 84 and 86 are adjacent opposite sides of the bore 34. The pawl 62 is sized to be received by the bore 34 so that the lobes 84 and 86 are closely adjacent the sidewall 34*b* and the pawl 62 can be pivoted as desired to selectively contact either the lobe 84 or the lobe 86 with the teeth 68 of the ratchet gear 60. That is, the bore 82 provides a central pivot point for selective bi-directional partial rotation of the plate 80 about the axis of the bore for desired positioning of the lobes 84 and 86 relative to the ratchet teeth 68, as described more fully below. The front portion 80*a* is sized smaller to not project into or otherwise contact the teeth 68 of the ratchet gear 60. The rear portion 80*b* is configured to lie closely adjacent the rim 34*b*, so as to contact the ball bearing 39*a* which is yieldably urged against the rear portion 80*b* by the compression coil spring 37*a* seated in the bore 35*a*.

A lower surface of the plate 80 is configured for matingly engaging a lever 88. For example, the lever 88 may include a square aperture 88*a* and the lower surface of the plate 80 having a corresponding square surface for fitting within the square aperture. 88*a*. The lever 88 is used to selectively rotate the plate 80, so as to selectively position the lobes 84 and 86.

The double-lobed pawl 64 is configured to be seated upon and overlie the pawl 62 and includes a plate 90 having a rounded front portion 90*a* and an opposite rounded rear portion 90*b*, a cylindrical extension 92 extending from a central location on a lower planar surface of the plate 90. A pair of lobes 94 and 96 protrude from opposite circumferential sides of the plate 90, such that the pawl 92 has a "butterfly shape" corresponding to the size and shape of the pawl 62.

The pawl 64 is sized similar to the pawl 62 and is seated onto the pawl 62 similar to the seating of the pawl 62 and pivotally overlies the pawl 62. That is, the front portion 90*a* is at the front of the bore 34 between the edges 33 adjacent the meeting of the bores 32 and 34, the rear portion 90*b* is at the rear of the bore 34 adjacent the shaft 20, and the lobes 94 and 96 are adjacent opposite sides of the bore 34. The ball bearing 39*b* is yieldably urged against the rear portion 90*b* by the compression coil spring 37*b* seated in the bore 35*b*.

The extension 92 of the pawl 64 provides a central pivot point for selective rotation of the plate 90 about the axis of the extension for desired positioning of the lobes 94 and 96, as described more fully below. The extension 92 includes an internally threaded bore for receiving a threaded fastener 98. The extension 92 is configured to pass through the bore 82 of the pawl 62 and to pass through the aperture 88*a* of the lever 88. A lower end 92*a* of the extension 92 is configured for matingly engaging a lever 100. For example, the lever 100 may include a square aperture 100*a* and the lower end 92*a* of the extension 92 has a corresponding square surface for fitting within the square aperture. 100*a*. The lever 100 is used to selectively rotate the plate 90, so as to selectively position the lobes 94 and 96.

The release mechanism 18 is provided by a pin 110 having a detent 112 formed near a distal end thereof and a head 114 located on the opposite end, together with the spring 76 and the ball bearing 76 described previously. The pin 110 is inserted into the longitudinal bore 72 of the ratchet gear 60 so that the detent 112 is adjacent the lateral bore 74, with the head 114 protruding from the opposite end of the bore 72. The spring 76 engages the surface of the pin 110 above the detent 112 so as to urge the bearing 78 against the narrowed open end of the bore 74 so that a portion of the bearing 78 extends out of the bore 74 to lock an object seated on the socket extension 70 from being unseated. The head 114 of the pin 110 may be depressed to position the detent 112 adjacent the bore 74 to enable the bearing 78 to be depressed into the bore 74 so that an object seated on the socket extension 70 may be disengaged from the socket extension. Likewise, the process may be reversed to seat an object on the socket extension 70. Thus, the release mechanism 18 enables the first tool component 12 and the second tool component 14 to be disengaged from one another for individual use.

A cover plate 120 is seated within a rim 122 defined on the end 26 adjacent the bores 32 and 34, and secured in place by threaded fasteners 124 threaded into threaded bores 126 formed into the rim 122. The cover plate 120 includes an aperture 126 for receiving the ring shaped body 66 so as to avoid friction between the cover plate and the ring gear 60 and for passage of the socket extension 70. A smaller aperture 128 may also be provided in the plate 120 for frictional clearance of an upper surface of the pawl 64.

Figure 8:
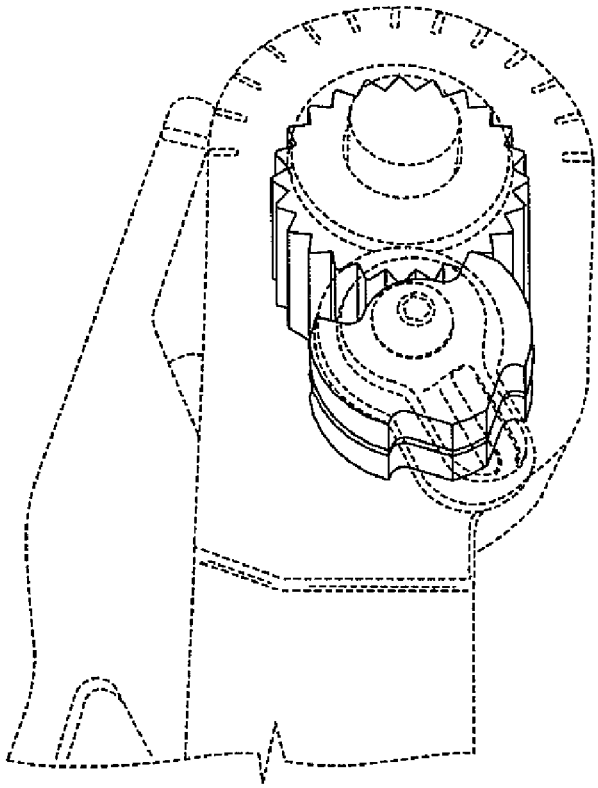
FIG. 8 shows relative orientation of first and second components of the ratchet system to enable relative movement of the tool components in one direction.
Figure 9:
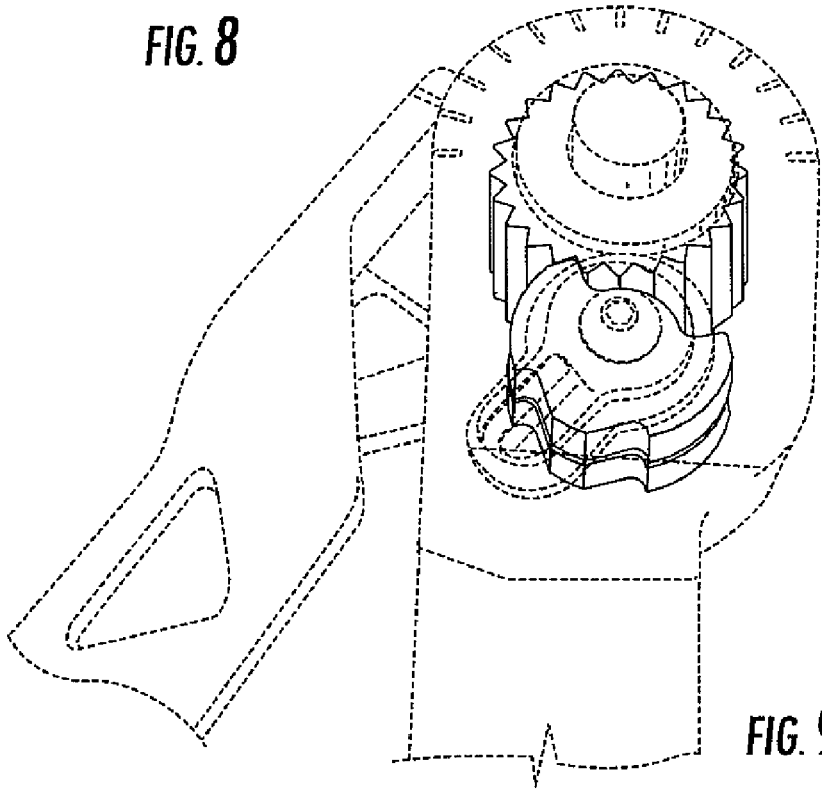
FIG. 9 shows relative orientation of first and second components of the ratchet system to enable relative movement of the tool components in the opposite direction.
Figure 10:
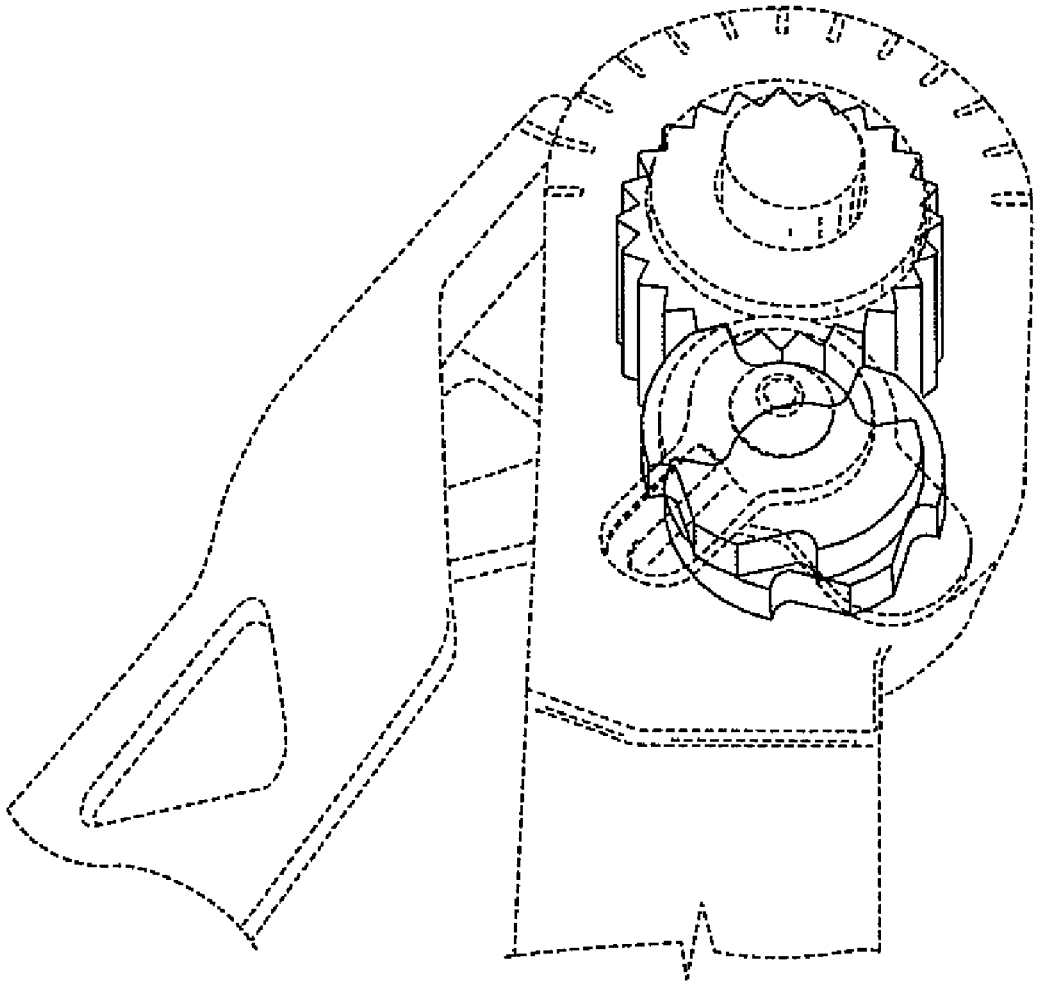
FIG. 10 shows relative orientation of first and second components of the ratchet system to lock the tool components relative to one another.

As mentioned previously, the ratchet system 16 enables the first tool component 12 and the second tool component 14 to be pivotally oriented relative to one another in a desired direction and to be locked at desired relative orientation. With reference to FIGS. 8-10, the levers 88 and 100 may be positioned relative to one another for desired interaction of the pawls 62 and 64 with the ratchet gear 60.

For example, as seen in FIG. 8, the pawls 62 and 64 are oriented by use of the levers 88 and 100 so that the pawls 62 and 64 are commonly situated so that the lobes 84 and 94 both bear against the ratchet teeth 68. This orientation will allow counter-clockwise movement of the ratchet teeth 68 (and hence the gear 60) relative to the pawls 62 and 64, but lock the ratchet teeth 68 (and hence the gear 60) from clockwise movement.

With reference to FIG. 9, the pawls 62 and 64 are oriented by use of the levers 88 and 100 so that the pawls 62 and 64 are commonly situated so that the lobes 82 and 92 both bear against the ratchet teeth 68. This orientation will allow clockwise movement of the ratchet teeth 68 (and hence the gear 60) relative to the pawls 62 and 64, but lock the ratchet teeth 68 and hence the gear 60) from counter-clockwise movement.

With reference to FIG. 10, the pawls 62 and 64 are oriented by use of the levers 88 and 100 so that the pawls 62 and 64 are not commonly situated so that the lobes 84 and 92 both bear against the ratchet teeth 68 from opposite sides. This orientation will lock the ratchet teeth 68 (and hence the gear 60) from counterclockwise and clockwise movement. Likewise, the levers 88 and 100 may be reversed, with the lobes 82 and 94 bearing on the ratchet teeth 68 from opposite sides to provide this same locking action. In addition, the levers 88 and 100 may be positioned so that none of the lobes 82, 84, 92, or 94 contact the ratchet teeth 68, such that the ratchet gear 60 may freely rotate clockwise and counter-clockwise.

As will be appreciated, the bearings 39*a* and 39*b* are urged by the springs 37*a* and 37*b* against the rounded rear portions 80*b* and 90*b* of the pawls 62 and 64, respectively, to retain the pawls 62 and 64 in their selected positions. However, by applying pressure to the levers 88 and 100, the user may overcome the spring pressure and re-orient each pawl as desired.

The tool 10 as depicted is configured to provide multiple functions. For example, representative tool functions provided by the tool 10 include a claw hammer, a finishing hammer, a multi-angle measuring tool, a wrecking bar, a pry bar, a ratchet wrench, and a ruler. These tool functions are provided by selective use of the components of the tool 10. For example, when the components 12 and 14 are assembled as shown in FIG. 1, a claw hammer function is provided.

Figure 2:
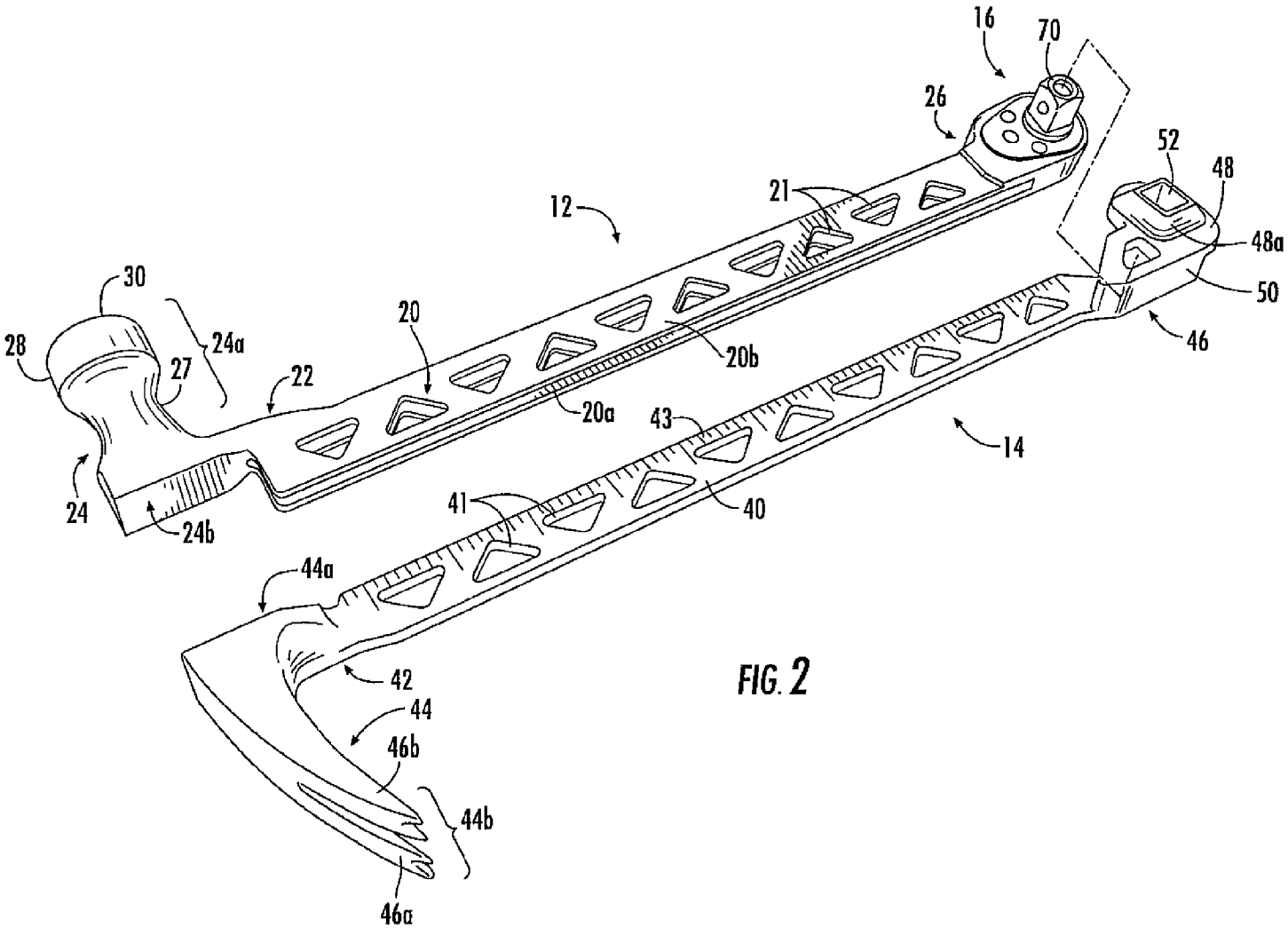
FIG. 2 shows the first and second tool components disengaged from one another.
Figure 7:
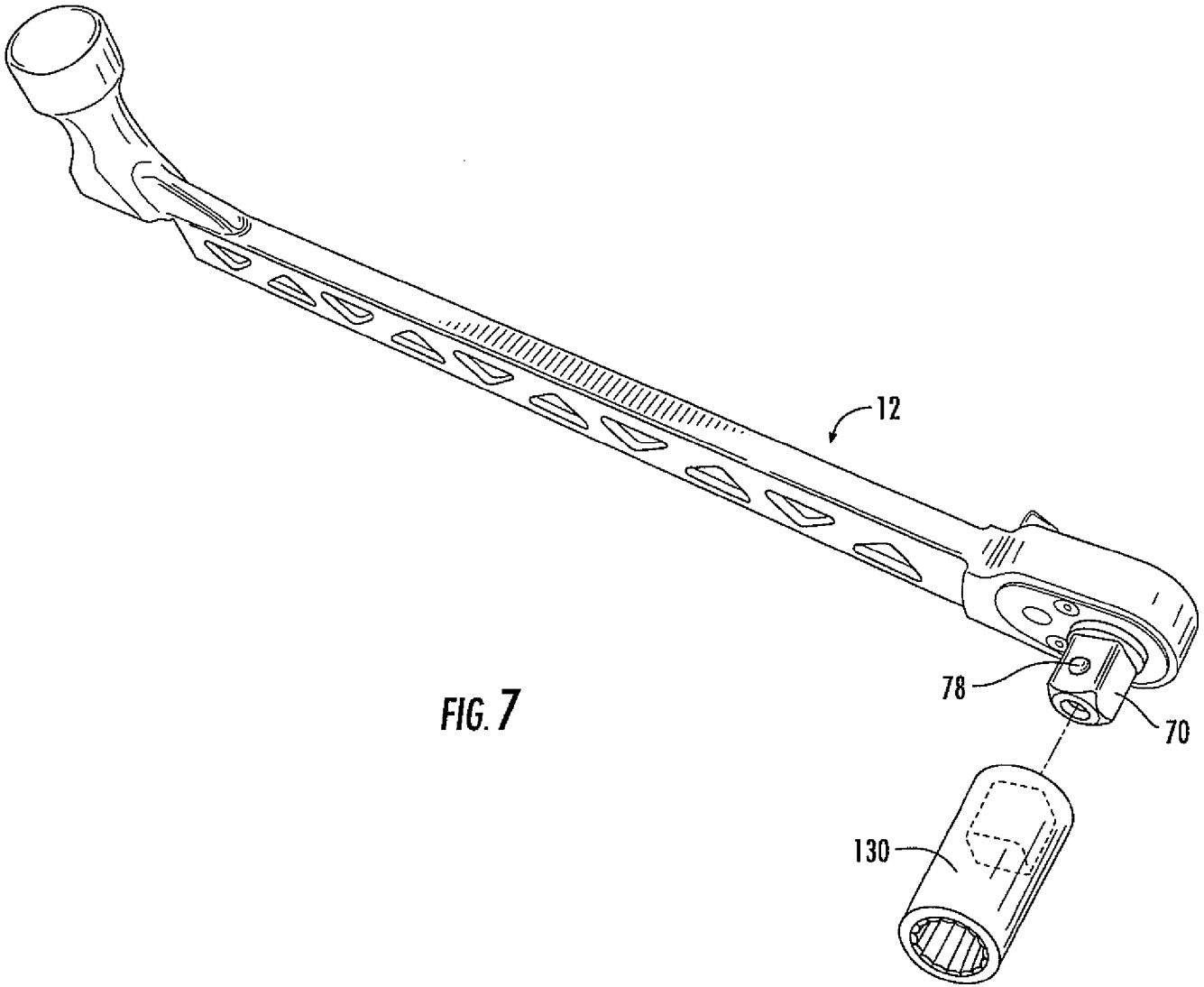
FIG. 7 is a perspective view showing installation of a socket onto the ratchet system to provide a socket wrench.

When the components 12 and 14 are removed from one another as shown in FIG. 2, the component 12 may be used as a finishing hammer and the component 14 as a pry bar and a ruler. As seen in FIG. 7, the component 12 may provide a socket wrench function, with a socket 130 positionable on the socket extension 70. As described previously, use of the levers 88 and 100 enables selective rotation of the ratchet teeth 68 so as to enable desired use of the socket 130 in a loosening or a tightening capacity, and the release mechanism enabling secure installation or removal of the socket 130 from the socket extension 70.

Figure 3:
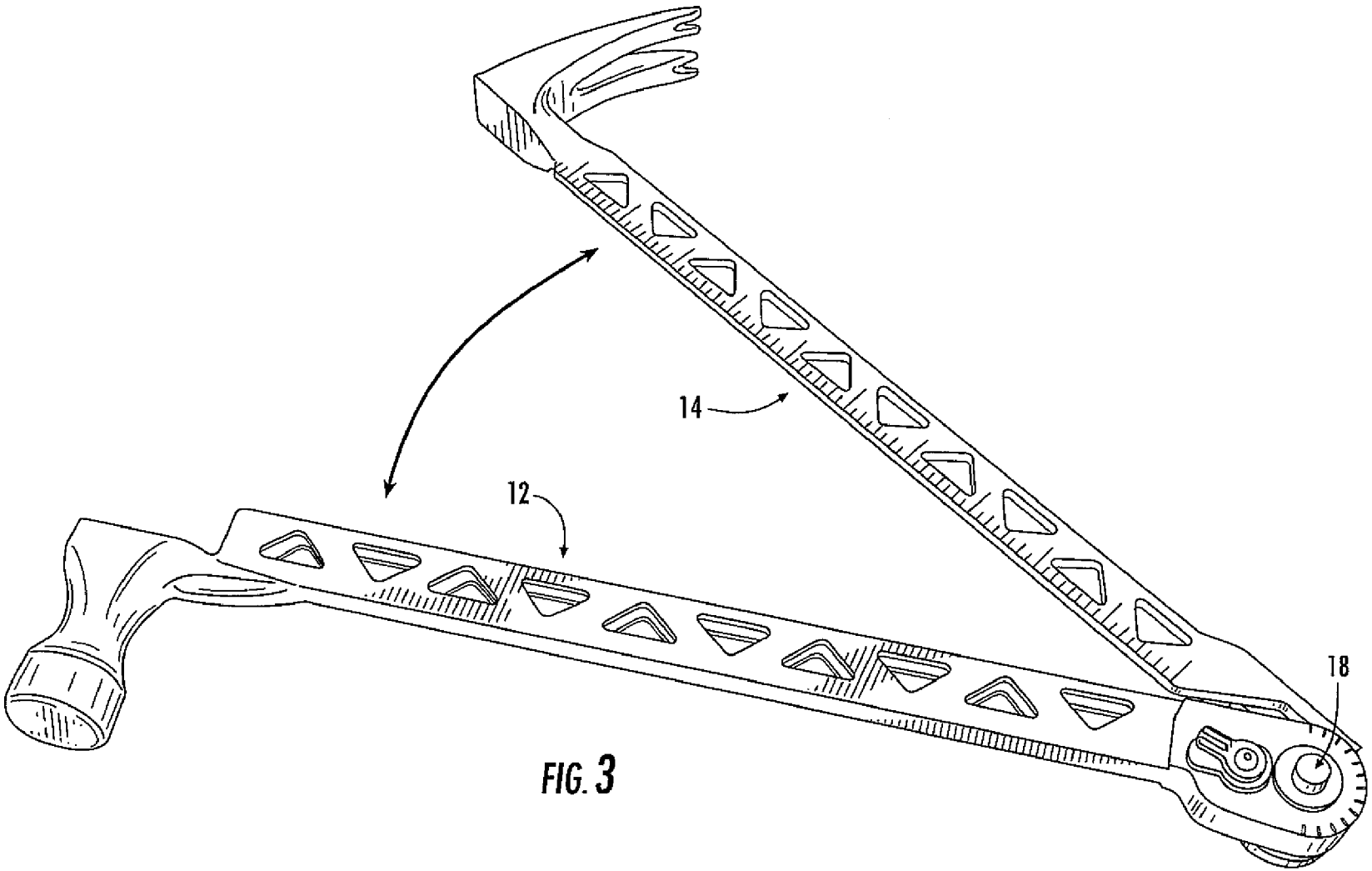
FIG. 3 is a perspective view of the tool of FIG. 1 in a partially unfolded orientation.
Figure 4:
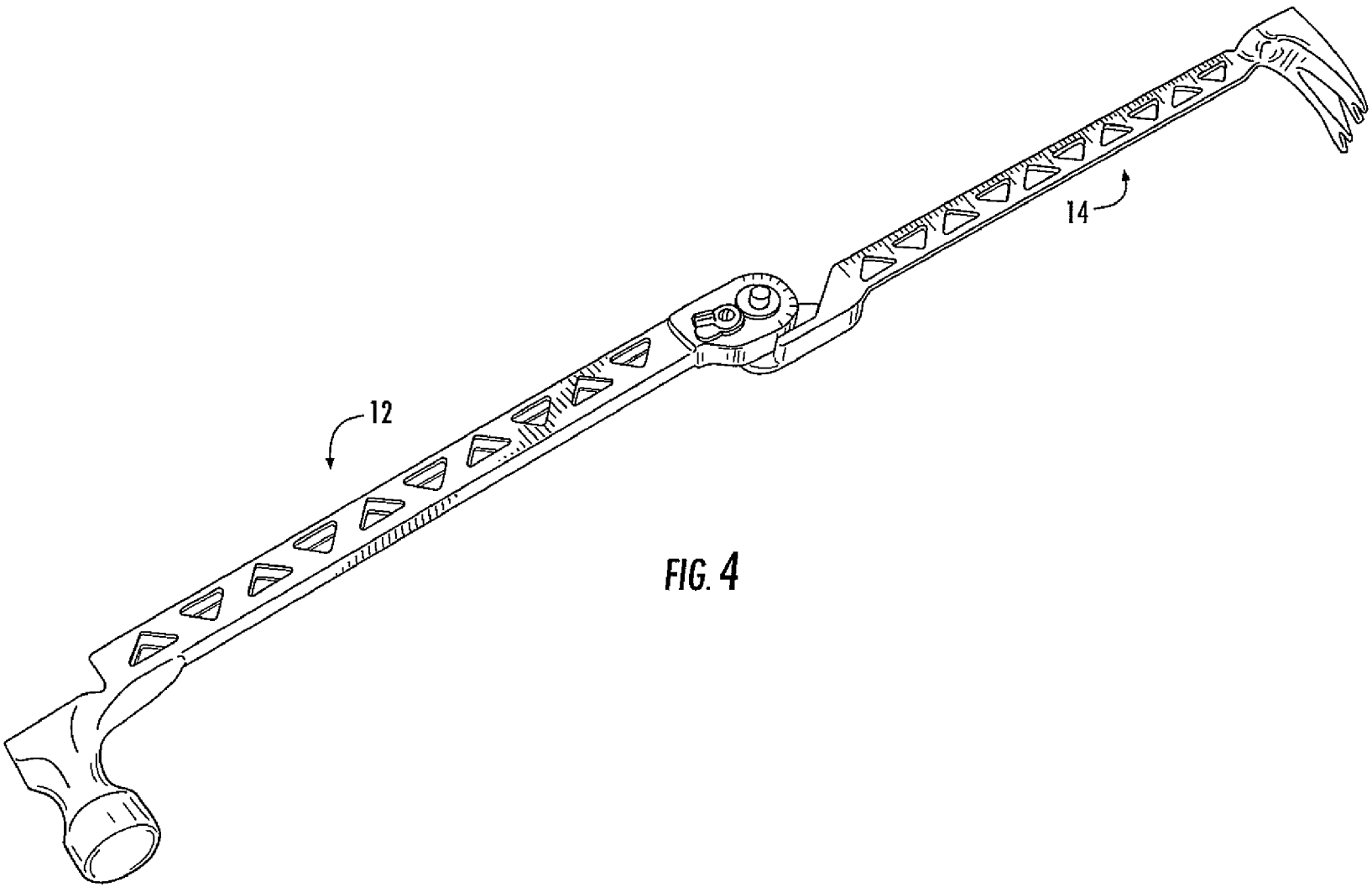
FIG. 4 is a perspective view of the tool of FIG. 1 in a fully unfolded orientation.

With reference to FIG. 3, the components 12 and 14 may be pivoted relative to one another by selective use of the levers 88 and 100, as described above, and used as a multi-angle measuring tool. When the components 12 and 14 are fully extended relative to one another, as shown in FIG. 4 and locked in this position, a wrecking bar function may be provided.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A combination tool, comprising:

a first tool component having a first elongate shaft provided by a pair of uniformly spaced apart shaft sections;

a second tool component having a second shaft configured to be received between the spaced apart shaft sections of the first shaft, a ratchet system incorporated into the first tool component and configured to enable the first tool component and the second tool component to be pivotally oriented relative to one another in a desired direction, and to be locked at desired relative orientation; and a release mechanism incorporated into the ratchet system and configured to enable the first tool component and the second tool component to be disengaged from one another for individual use.

2. The tool of claim 1, wherein the first tool component includes a shaft having a first end configured to provide a partial hammer head and an opposite second end configured to receive the ratchet system.

3. The tool of claim 2, wherein the second tool component includes a shaft having a first end configured to provide a hammer claw configured to mate with the partial hammer head of the first tool component and an opposite second end configured to cooperate with the second end of the first tool component to mate with the ratchet system.

4. The tool of claim 1, wherein the ratchet system includes a ratchet gear having circumferential ratchet teeth located around the periphery thereof; and a pair of independently positionable double-lobed pawls positioned to overlie one another adjacent to the ratchet gear, each double-lobed pawl having a rounded front portion, an opposite rounded rear portion, and a pair of lobes protruding from opposite circumferential sides thereof, the pawls being independently pivotable to selectively contact one of each of the lobes each of the pawls in engagement or disengagement with the teeth of the ratchet gear to enable desired directional rotation of the ratchet gear or locking of the ratchet gear against rotation.

5. The tool of claim 4, wherein the second end of the first tool component includes a pair of stacked bores, one aligned with and adjacent each of the pawls, each bore including a compression spring seated therein and a cooperating ball bearing positioned by the spring to yieldably urge against a portion of the adjacent pawl.

6. The tool of claim 4, wherein the pawls are each butterfly shaped.

7. The tool of claim 4, wherein the bores are aligned in a stacked configuration and extend into one another between meeting edges of the bores so that the bores are in communication with one another and have an overall figure-eight appearance.

8. A ratchet system, comprising:

a tool end providing a first bore and a second bore aligned in a stacked configuration and extending into one another between meeting edges of the bores so that the bores are in communication with one another and have an overall figure-eight appearance, a ratchet gear having circumferential ratchet teeth located around the periphery thereof and seated within the second bore; and a pair of independently positionable double-lobed pawls positioned within the first bore to overlie one another adjacent to the ratchet gear, each double-lobed pawl having a rounded front portion, an opposite rounded rear portion, and a pair of lobes protruding from opposite circumferential sides thereof, the pawls being independently pivotable to selectively contact one of each of the lobes of each of the pawls in engagement or disengagement with the teeth of the ratchet gear to enable desired directional rotation of the ratchet gear or locking of the ratchet gear against rotation.

9. The ratchet system of claim 8, wherein the first bore includes a first sidewall into which extend a pair of aligned and vertically stacked small bores, each small bore receiving a compression spring onto which is seated a bearing; each of the small bores being aligned with and adjacent one of the pawls such that each of the ball bearings is yieldably urged against a portion of the pawl adjacent thereto.

* * * * *